US010365604B2

(12) United States Patent
Fuse

(10) Patent No.: US 10,365,604 B2
(45) Date of Patent: Jul. 30, 2019

(54) IMAGE FORMING APPARATUS, CONVEYING UNIT, AND TRANSMISSION MEMBER

(71) Applicant: CANON KABUSHIKI KAISHA, Tokyo (JP)

(72) Inventor: Yasuhiko Fuse, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/151,096

(22) Filed: Oct. 3, 2018

(65) Prior Publication Data

US 2019/0113884 A1 Apr. 18, 2019

(30) Foreign Application Priority Data

Oct. 13, 2017 (JP) ..... 2017-199629

(51) Int. Cl.
*G03G 21/18* (2006.01)
*G03G 15/08* (2006.01)
*G03G 15/00* (2006.01)

(52) U.S. Cl.
CPC ..... *G03G 21/1842* (2013.01); *G03G 15/0891* (2013.01); *G03G 15/757* (2013.01); *G03G 21/186* (2013.01)

(58) Field of Classification Search
CPC ..... G03G 21/1842; G03G 21/186; G03G 15/0891; G03G 15/757
See application file for complete search history.

(56) References Cited

U.S. PATENT DOCUMENTS

2010/0037717 A1* 2/2010 Takagi ..... E06B 9/322 74/63
2011/0031774 A1* 2/2011 Koga ..... B60N 2/067 296/65.15
2013/0313060 A1* 11/2013 Takada ..... F16D 41/203 192/46
2014/0048025 A1* 2/2014 Watanabe ..... F01L 1/34 123/90.15

(Continued)

FOREIGN PATENT DOCUMENTS

JP 2000132064 A 5/2000
JP 2011107637 A 6/2011

(Continued)

*Primary Examiner* — G. M. A Hyder
(74) *Attorney, Agent, or Firm* — Canon U.S.A., Inc. IP Division

(57) ABSTRACT

A transmission member configured to transmit driving of a driving member to a driven member includes a first engaging portion for engaging with the driving member and a spring portion having a shape wound around an axis. The spring portion is to be compressed in a direction of the axis. The spring portion includes a first wound portion wound around the axis and a second wound portion wound around the axis. The second wound portion is connected to the first wound portion and includes a small-radius portion. The small-radius portion is disposed such that, when the spring portion is projected in the direction of the axis, an outer portion of the small-radius portion is projected to inside of a mid-portion between an outer portion of the first wound portion and an inner portion of the first wound portion in a direction perpendicular to the axis.

20 Claims, 12 Drawing Sheets

(56) References Cited

U.S. PATENT DOCUMENTS

| | | | | |
|---|---|---|---|---|
| 2015/0042052 | A1* | 2/2015 | Furusawa | B24B 23/04 279/141 |
| 2017/0329279 | A1* | 11/2017 | Hirayama | G03G 21/10 |
| 2018/0348700 | A1* | 12/2018 | Hirayama | G03G 15/0886 |

FOREIGN PATENT DOCUMENTS

| | | | |
|---|---|---|---|
| JP | 2017072177 | A | 4/2017 |
| WO | 2016137012 | A1 | 9/2016 |

* cited by examiner

IMAGE FORMING APPARATUS, CONVEYING UNIT, AND TRANSMISSION MEMBER

BACKGROUND OF THE INVENTION

Field of the Invention

The present disclosure relates to an electrophotographic image forming apparatus, and a conveying unit and a transmission member for use in the electrophotographic image forming apparatus.

Examples of the electrophotographic image forming apparatus include electrophotographic copying machines and electrophotographic printers (a laser beam printer, a light-emitting diode (LED) printer, and so on).

The conveying unit is mounted to the main body of an electrophotographic image forming apparatus to convey a developer.

Description of the Related Art

There is a known configuration in the art for the electrophotographic image forming apparatus in which rotational members for image formation, such as a photosensitive drum and a developing roller, are integrated as a cartridge and in which the cartridge is removably mounted to the main body of the image forming apparatus.

For such an image forming apparatus, there is known a configuration in which a transfer residual toner remaining on the surface of the photosensitive drum (hereinafter referred to as "residual toner") is held in the cartridge in a cleaning process during image formation.

International Publication No. WO 2016/137012 A1 discloses a configuration in which waste toner generated in the cleaning process during image formation is conveyed from the cartridge to the main body of the image forming apparatus (hereinafter referred to as "apparatus main body") and is finally put in a toner container provided in the apparatus main body.

The configuration disclosed in International Publication No. WO 2016/137012 A1 is such that a rotational member (corresponding to a driving member) on the cartridge side and a rotational member (corresponding to a driven member or a conveying member) on the main body side are connected to transmit the driving in order to efficiently convey waste toner using a limited driving source. Thus, the waste toner is smoothly conveyed. The configuration uses a deformable elastic member (a spring) between the cartridge-side rotational member and the apparatus-main-body-side rotated member as a transmission member for transmitting the driving.

However, if the transmission member (elastic member) provided between the cartridge-side driving member and the apparatus-main-body-side driven member is not recovered in the deformed state, the engagement between the transmission member and the cartridge-side driving member can become unstable. This can require checking whether the deformation of the transmission member has not been kept (whether the transmission member has been recovered from deformation).

SUMMARY OF THE INVENTION

One aspect of the disclosure is the prevention of an occurrence of a state in which deformation of a transmission member that transmits driving from a driving member to a driven member is kept.

According to a first aspect of the present disclosure, a conveying unit driven by a driving member to convey a developer includes a conveying member configured to covey the developer and a transmission member configured to transmit driving of the driving member to the conveying member. The transmission member includes a first engaging portion for engaging with the driving member, a second engaging portion for engaging with the conveying member, and a spring portion having a shape wound around an axis. The first engaging portion is disposed at an end of the transmission member. The spring portion is to be compressed in a direction of the axis. The spring portion includes a first wound portion wound around the axis and a second wound portion wound around the axis. The second wound portion is connected to the first wound portion and includes a small-radius portion. The small-radius portion is disposed such that, when the spring portion is projected in the direction of the axis, an outer portion of the small-radius portion is projected to inside of a mid-portion between an outer portion of the first wound portion and an inner portion of the first wound portion in a direction perpendicular to the axis.

According to a second aspect of the present disclosure, a transmission member configured to transmit driving of a driving member to a driven member includes a first engaging portion for engaging with the driving member, a second engaging portion for engaging with the driven member, and a spring portion having a shape wound around an axis. The first engaging portion is disposed at an end of the transmission member. The spring portion is to be compressed in a direction of the axis. The spring portion includes a first wound portion wound around the axis and a second wound portion wound around the axis. The second wound portion is connected to the first wound portion and includes a small-radius portion. The small-radius portion is disposed such that, when the spring portion is projected in the direction of the axis, an outer portion of the small-radius portion is projected to inside of a mid-portion between an outer portion of the first wound portion and an inner portion of the first wound portion in a direction perpendicular to the axis.

The present disclosure can also be applied to an image forming apparatus including the conveying unit or the transmission member described above.

Further features and aspects of the disclosure will become apparent from the following description of example embodiments with reference to the attached drawings.

DESCRIPTION OF THE EMBODIMENTS

Numerous embodiments of the present disclosure will be described hereinbelow with reference to the drawings. However, the dimensions, materials, shapes, and the relative dispositions of the components described in the embodiments should be appropriately changed according to the configuration of the apparatus to which the present disclosure is applied and various conditions. In other words, the scope of the present disclosure is not limited to the following embodiments.

In the present embodiments, the vertical direction is the vertical direction in the direction of gravity unless otherwise specified. The direction of gravity is the direction of gravity when an apparatus or a component to which the present disclosure is applied is in the usual posture. In the following description, the usual posture is a posture when an image is formed on a recording material.

Unless otherwise specified, a projection image is an image of an object projected to a plane perpendicular to a projecting direction viewed from the upstream side of the projecting direction.

First Example Embodiment

Referring to FIGS. 1 to 11 and FIG. 18, a driving transmission member (a transmission member) in a toner conveying unit (a conveying unit) of a first embodiment of the present disclosure and an image forming apparatus including the same will be described hereinbelow. The image forming apparatus is an apparatus that forms an image on a recording medium using an electrophotographic image forming process. Examples include electrophotographic copying machines, electrophotographic printers (for example, an LED printer and a laser beam printer), and an electrophotographic facsimile machines.

Figure 4:
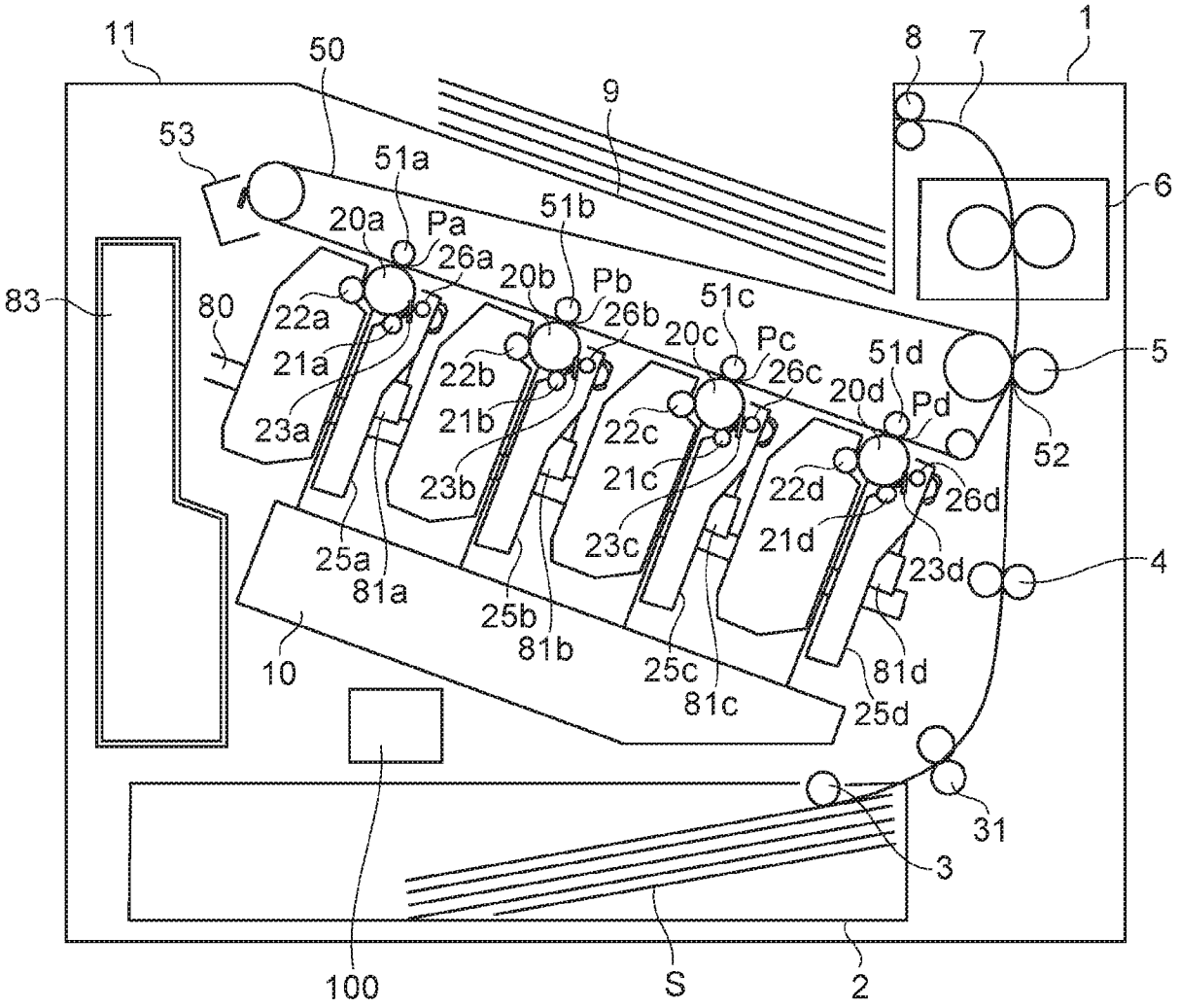
FIG. 4 is a schematic cross-sectional view of an entire example image forming apparatus.

Referring first to FIG. 4, the schematic configuration of the entire image forming apparatus will be described along the flow of a sheet (a recording material) S. FIG. 4 is a schematic cross-sectional view of the entire image forming apparatus.

The image forming apparatus 1 forms an image using an electrophotographic image forming process. The image forming apparatus 1 conveys sheets (recording materials) S, which are recording media, to a transfer portion 52 to transfer a toner image, conveys the sheets S to a fixing unit 6 to fix the toner image, and discharges the sheets S to an output tray 9.

The sheets S are stacked and contained in a cassette 2, which is a sheet container (a sheet tray), mounted at the bottom of the image forming apparatus 1. The sheets S are lifted by a medium plate (not illustrated) in the cassette 2 and are fed out from an uppermost sheet S one by one by a sheet feeding roller 3 (a sheet feeding unit). The fed out sheets S are conveyed to the transfer portion 52 by a conveying roller pair 31 and a registration roller 4 that controls the positions of the sheets S.

An image forming unit includes first to fourth four image forming units (Pa, Pb, Pc, and Pd). The image forming units (Pa, Pb, Pc, and Pd) respectively form yellow (Y)Pa, magenta (M)Pb, cyan (C)Pc, and black (K)Pd images and have the same configuration except that the colors of the toners are different. Signs a, b, c, and d shown in FIG. 4 respectively indicate components corresponding to the image forming units for yellow (Y)Pa, magenta (M)Pb, cyan (C)Pc, and black (K)Pd. However, signs a, b, c, d will be omitted in the following description in the case where there is no need to distinguish among colors.

The image forming units (Pa, Pb, Pc, and Pd) each include a photosensitive drum 20 and a charging roller 21, a developing roller 22, and a cleaning blade 23, which are processing units for the photosensitive drum 20. They are integrated into a process cartridge (hereinafter referred to as "cartridge") and are removably mounted to the image forming apparatus 1. A component excluding the removably replacement component, such as the cartridge 25, from the image forming apparatus 1 is referred to as an image forming apparatus main body (hereinafter referred to as "apparatus main body 11"), which is sometimes distinguished from the image forming apparatus 1. The apparatus main body 11 includes a CPU 100 serving as a controller for image formation.

The photosensitive drum 20 is an image bearing member that carries an electrostatic latent image. The charging roller 21 is a charging member that electrically charges the surface of the photosensitive drum 20. The cleaning blade 23 is a cleaning member for cleaning the surface of the photosensitive drum 20. The cleaning blade 23 removes toner from the surface of the photosensitive drum 20. The developing roller 22 is a developer bearing member that carries toner (a developer). The developing roller 22 supplies the toner, or the developer, to the surface of the photosensitive drum 20. Examples of the cleaning member include a roller-shaped cleaning member and a brush-like cleaning member.

The image forming operation will be described. First, the surface of the photosensitive drum 20 is uniformly charged by the charging roller 21. The surface of the photosensitive drum 20 charged by the charging roller 21 is exposed to light by a laser scanner 10 serving as an exposure unit. Thus, an electrostatic latent image corresponding to image information is formed on the surface of the photosensitive drum 20. The developing roller 22 develops the electrostatic latent image with toner.

An endless intermediate transfer belt 50 serving as an intermediate transfer member to which the image (a toner image) developed on the surface of each photosensitive drum 20 is transferred is opposed to the photosensitive drum 20. Furthermore, a primary transfer roller 51 serving as a transfer unit for transferring the toner image to the intermediate transfer belt 50 is disposed inside the intermediate transfer belt 50 in correspondence with each cartridge.

The toner images (primary images) transferred to the intermediate transfer belt 50 are transferred to the sheet (the recording material) S by a secondary transfer roller 5 (secondary transfer).

The sheet S on which the unfixed toner images are formed is conveyed to a fixing unit 6 and are fixed by heating while passing through a fixing nip. The sheet S passes through a sheet discharge path 7 and is discharged to the outside of the image forming apparatus 1 by a discharge roller pair 8 onto an output tray 9.

Toner that is not transferred by the primary transfer roller 51 and remains on the photosensitive drum 20 (hereinafter referred to as "residual toner") is collected into the cartridge by the cleaning blade 23. The collected residual toner is conveyed by a residual toner conveying member (a conveying screw) 26 on the cartridge side. The residual toner passes through a toner conveying path 80 into a residual toner container 83 in the apparatus main body 11. Residual toner that is not transferred by the secondary transfer roller 5 and remains on the intermediate transfer belt 50 is collected into a transfer unit including the intermediate transfer belt 50 by an intermediate-transfer-belt cleaner 53.

In the present embodiment, the process cartridge 25 is mounted to the apparatus main body 11 in the direction of the axis of the photosensitive drum 20. However, this is given merely for illustrative purposes. A photosensitive drum unit (a photosensitive drum cartridge) including the photosensitive drum 20 and a developing unit (a developing cartridge) including the developing roller 22 may be independently removably mounted. In this case, the photosensitive drum unit may be removably mounted in the direction of the axis of the photosensitive drum 20, and the developing unit may be removably mounted in the direction of the axis of the developing roller 22.

Example Toner Conveying Path

Figure 5:
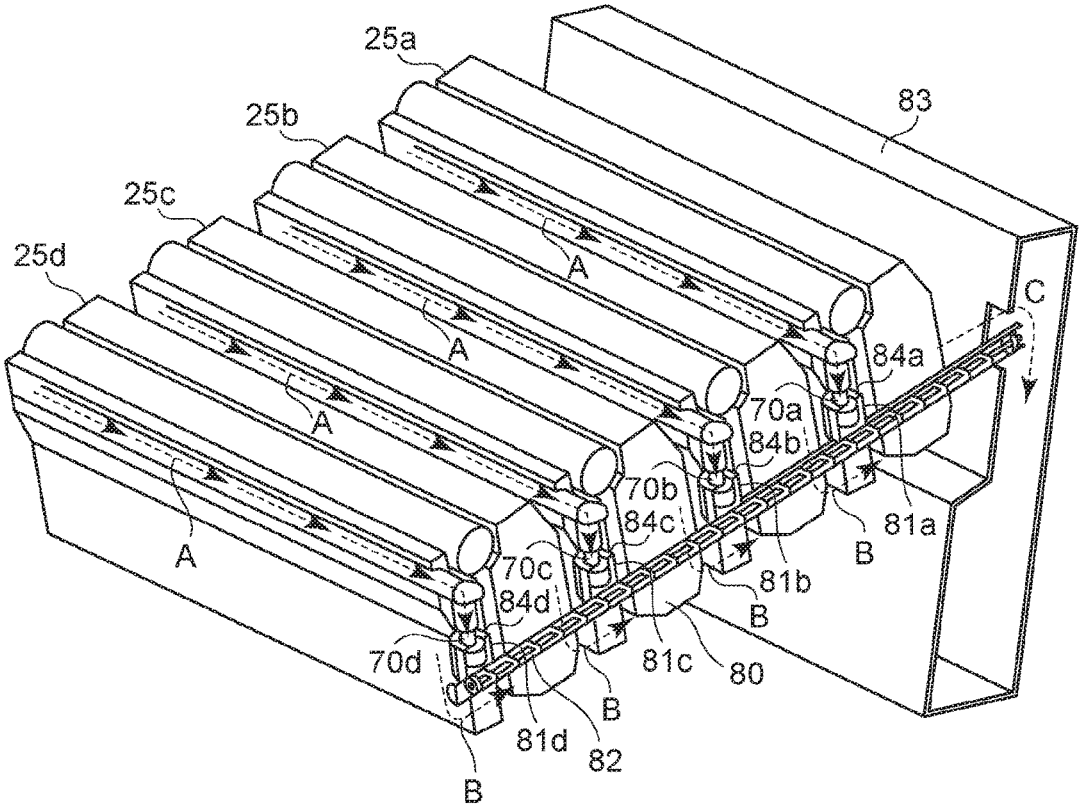
FIG. 5 is a perspective view of cartridges and the entire toner conveying path of the apparatus main body.

The overall configuration of the toner conveying path will be described along the flow of the toner with reference to FIGS. 4 and 5. FIG. 5 is a perspective view of the cartridges 25 and the entire toner conveying path of the apparatus main body 11.

Referring to FIG. 4, residual toner remaining on the photosensitive drum 20 of the cartridge 25 is collected (removed) by the cleaning blade 23 in the cartridge 25. The collected residual toner is conveyed by the conveying screw 26 in the cartridge 25 to the back of the apparatus main body 11 (indicated by dotted arrow A in FIG. 5). In the present embodiment, the arrow A is substantially parallel to the axis of the photosensitive drum 20, and the downstream side of the arrow A is downstream in the direction in which the cartridge 25 is mounted.

The cartridge 25 includes a toner discharging unit 70 for discharging the toner downstream of the arrow A. The residual toner conveyed in the direction of arrow A is discharged from the toner discharging unit 70 of the cartridge 25.

As illustrated in FIG. 5, the apparatus main body 11 of the image forming apparatus 1 includes a toner receiving unit 84 for receiving the residual toner discharged from the toner discharging unit 70. The residual toner is discharged from the toner discharging unit 70 and is received by the toner receiving unit 84 in the toner conveying path 80 of the apparatus main body 11. The toner receiving units 84 (84*a*, 84*b*, 84*c*, and 84*d*) are disposed in correspondence with the respective toner discharging units 70 (70*a*, 70*b*, 70*c*, and 70*d*) of the cartridges 25 (25*a*, 25*b*, 25*c*, and 25*d*).

First conveying paths 81 (81*a*, 81*b*, 81*c*, and 81*d*) are each disposed below the toner receiving unit 84. The residual toner received by the toner receiving unit 84 passes through the interior of the first conveying path 81 downward.

A second conveying path 82 is connected to the lower end of the first conveying path 81 in a direction substantially perpendicular to the first conveying path 81. The second conveying path 82 includes a second conveying screw 80*a* therein. The residual toner is conveyed in the second conveying path 82 along dotted arrow B in FIG. 5.

A toner container 83 is provided downstream in the conveying direction of the second conveying screw 80*a*. The residual toner conveyed by the second conveying screw 80*a* is finally sent to an upper part of the toner container 83 along dotted arrow C. The toner container 83 is removably mounted to the apparatus main body 11 so as to be replaced.

As illustrated in FIG. 4, the first conveying path 81 of the present embodiment is inclined with respect to the vertical direction. The second conveying path 80 is inclined with respect to the horizontal direction, and the second conveying screw 80*a* is inclined upward with respect to the horizontal direction to convey the residual toner. Alternatively, the first conveying path 81 may extend in the vertical direction. The second conveying path 80 and the second conveying screw 80*a* may extend in the horizontal direction or diagonally downward.

Example Connection of Toner Conveying Path

Referring to FIGS. 6, 7, 8, 9, and 10, the configuration of the connection of the cartridge 25 and the toner conveying path of the apparatus main body 11 will be described in more detail.

Figure 6:
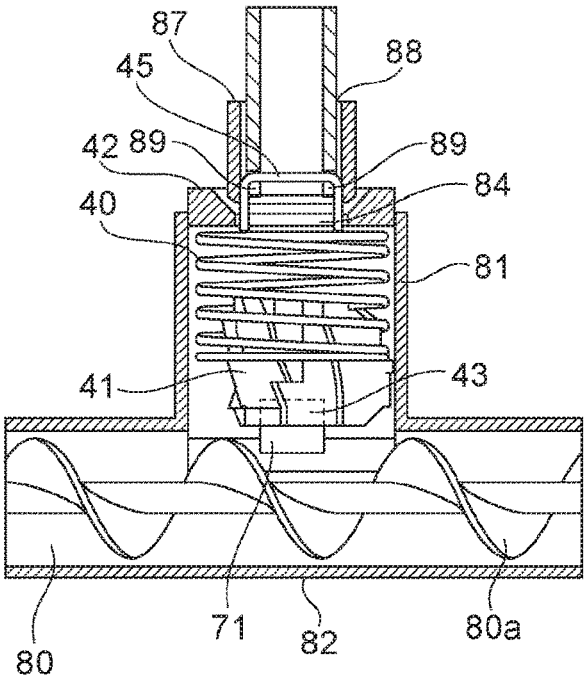
FIG. 6 is a cross-sectional view of a toner receiving unit of the toner conveying path of the apparatus main body.
Figure 7:
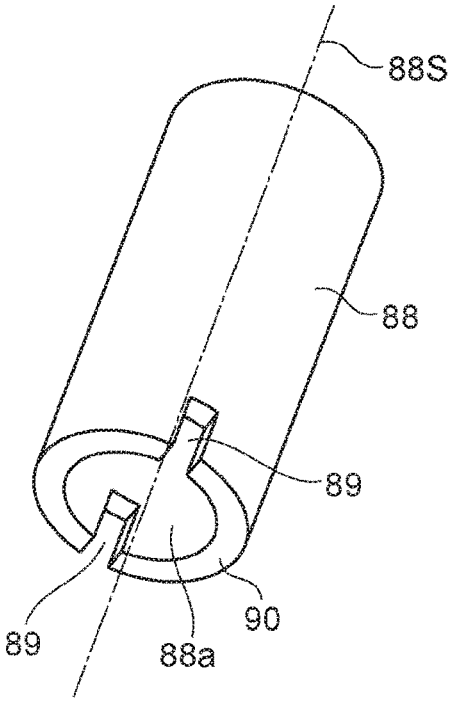
FIG. 7 is a perspective view of a driving member of the cartridge.
Figure 8:
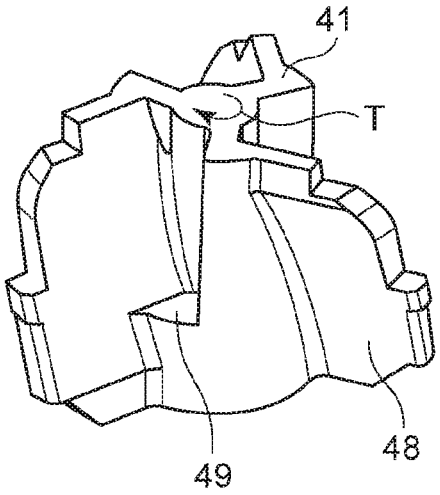
FIG. 8 is a perspective view of a conveying member (a driven member) that conveys toner.
Figure 9:
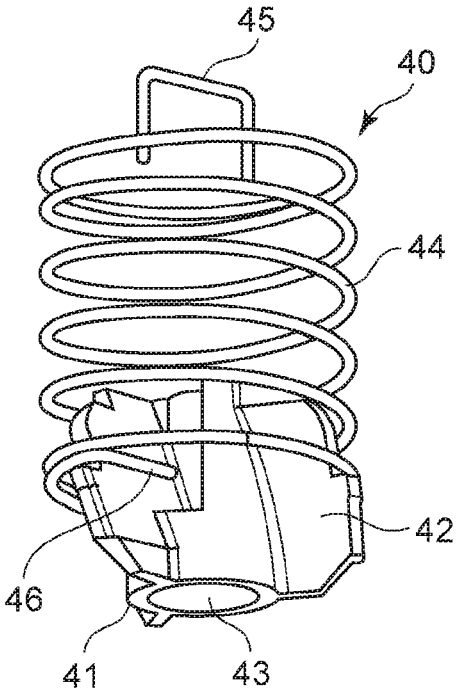
FIG. 9 is a perspective view of a transmission spring and a conveying fin illustrating an engaged state thereof.
Figure 10:
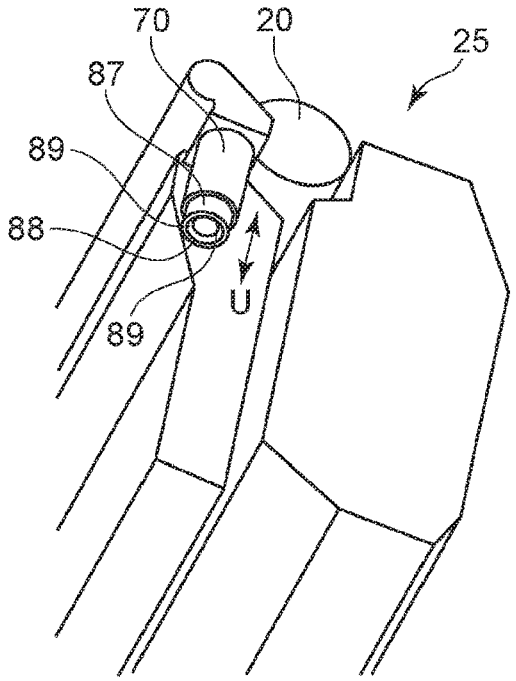
FIG. 10 is a perspective view of a toner discharge port of the cartridge.

FIG. 6 is a cross-sectional view of the toner receiving unit 84 of the toner conveying path of the apparatus main body 11. FIG. 7 is a perspective view of the driving member (a rotational member) of the cartridge 25. FIG. 8 is a perspective view of the conveying member (a driven member) that conveys toner. FIG. 9 is a perspective view of a transmission spring and a conveying fin illustrating an engaged state thereof. FIG. 10 is a perspective view of a toner discharge port of the cartridge 25.

As illustrated in FIG. 10, the toner discharging unit 70 includes a toner-conveying-path connecting member (hereinafter referred to as "connecting member") that is extendably slid in the direction of arrow U in FIG. 10. The connecting member 87 moves in conjunction with the closing motion of a front door (not illustrated) provided on the apparatus main body 11 and covering the cartridge mount portion. When the front door is closed, the connecting member 87 is pushed down by a link mechanism (not illustrated). The connecting member 87 is configured to move to a position where toner is received by the toner receiving unit 84 on the apparatus main body side illustrated in FIG. 6.

As illustrated in FIGS. 7 and 10, the driving member 88 (a first rotational member) is disposed inside the connecting member 87. In other words, the cartridge 25 includes the driving member 88. The driving member 88 has a cylindrical shape. The driving member 88 is configured to be rotated around the axis of the cylinder by a driving force that drives the photosensitive drum 20 of the cartridge 25. The driving member 88 has two engaging grooves (engaged portions on the driving member side) 89 at an end 90 of the cylinder of the driving member 88. The engaging grooves 89 engage with first engaging portions 45 of a transmission spring 40 (to be described later, see FIG. 11).

As described above, the driving member 88 has a cylindrical shape having a space therein. This allows the residual toner to pass through the driving member 88. In other words, the driving member 88 can contact with the toner. As illustrated in FIG. 7, the driving member 88 includes at the end 90 a discharge port (opening) 88*a* through which the residual toner is discharged toward a conveying fin 41. The residual toner is discharged from the discharge port 88*a* in a direction including the rotation axis (88S) of the driving member 88.

As illustrated in FIG. 6, the first conveying path 81 includes the transmission spring 40 (a transmission member) which is a rotatable elastic member and the conveying fin 41 (the driven member, or a second rotational member) which is a conveying member for conveying toner. The transmission spring 40 includes at one end a first engaging portion 45 (a first engaging portion) that engages with the engaging grooves 89 of the driving member 88. As illustrated in FIG. 9, the transmission spring 40 includes at the other end a second engaging portion 46 that engages with the conveying fin 41 (the second rotational member). Since the transmission spring 40 is disposed in the first conveying path 81, the transmission spring 40 can contact with the residual toner discharged from the driving member 88. The transmission spring 40 is disposed so that the rotation axis 88S of the driving member 88 passes inside a spring portion 40*a* (to be described later, see FIG. 2).

When the driving member 88 rotates, with the first engaging portion 45 and the engaging grooves 89 engaging with each other, the transmission spring 40 rotates together with the driving member 88. The transmission spring 40 thus transmits the driving force of the driving member 88 to the conveying fin 41. The conveying fin 41 rotates together with the transmission spring 40. The transmission spring 40 is a transmission member (a driving transmission member) that transmits the driving of the driving member 88 to the conveying fin 41, and so it has the function of so-called coupling.

In summary, the conveying fin 41 is a driven member driven by the driving member 88 and serves as a conveying member for conveying toner. The transmission spring 40 is a transmission member that transmits the driving of the driving member 88 to the conveying fin 41. The conveying unit of the present embodiment includes the transmission spring 40 and the conveying fin 41. The apparatus main body 11 of the image forming apparatus 1 includes the conveying unit. In the present embodiment, the cartridge 25 to be replaced includes the photosensitive drum 20 and the cleaning blade 23. The cartridge 25 further includes the driving member 88 configured to come into contact with toner removed from the surface of the photosensitive drum 20 by the cleaning blade 23. The cartridge 25 is a replaceable component that is removably mounted to the apparatus main body 11. The driving member 88, the transmission spring 40, and the conveying fin 41 are disposed on the conveying path through which the residual toner is conveyed.

FIG. 8 is a perspective view of an example of the conveying fin 41. The residual toner flowing to the conveying fin 41 is conveyed vertically downward by a conveying portion 48 of the conveying fin 41 having a screw blade shape as the conveying fin 41 rotates in the direction of arrow T. In other words, the conveying fin 41 can contact with the toner. The conveying fin 41 has a groove 49 so as to come into engagement with the transmission spring 40 and rotate therewith.

FIG. 9 is a perspective view of the transmission spring 40 and the conveying fin 41 integrated with each other. As illustrated in FIG. 9, the conveying fin 41 has a recess 43. As illustrated in FIG. 6, the recess 43 of the conveying fin 41 engages with a fin bearing 71 in the toner conveying path 80. Thus, the conveying fin 41 is supported so as to rotate in the direction of T illustrated in FIG. 8.

The residual toner is sent from the toner receiving unit 84 to the second conveying path 82 vertically therebelow via the transmission spring 40 and the conveying fin 41. Thereafter, the residual toner is conveyed in the horizontal direction by the conveying screw 80*a* in the second conveying path 82.

The conveying screw 80*a* is configured to be rotated by a driving force from a motor (not illustrated), which is a driving source provided in the apparatus main body 11. As described above, the conveying fin 41 is configured to convey the residual toner by rotating in engagement with the driving member 88 provided in the cartridge 25.

Example Connecting Operation

An operation for connecting the apparatus main body with the toner conveying path at the insertion of a cartridge will be described with reference to FIGS. 6, 7, 10, 11, and 18.

Figure 11:
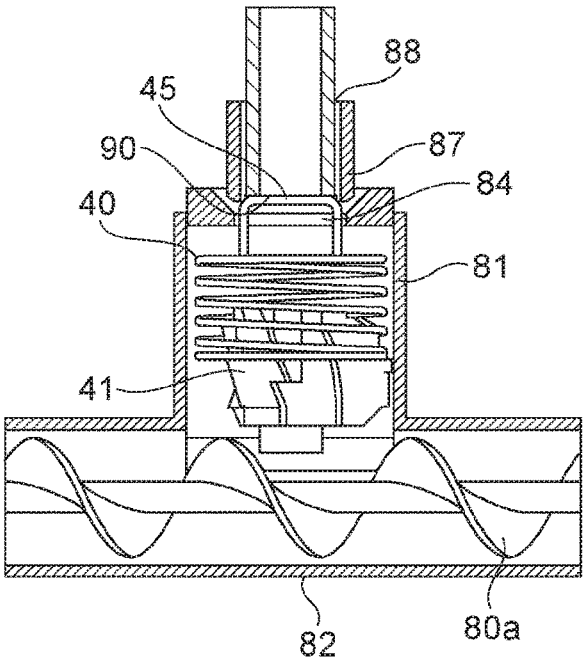
FIG. 11 is a cross-sectional view of the transmission spring compressed by an end of the driving member of the cartridge.
Figure 18:
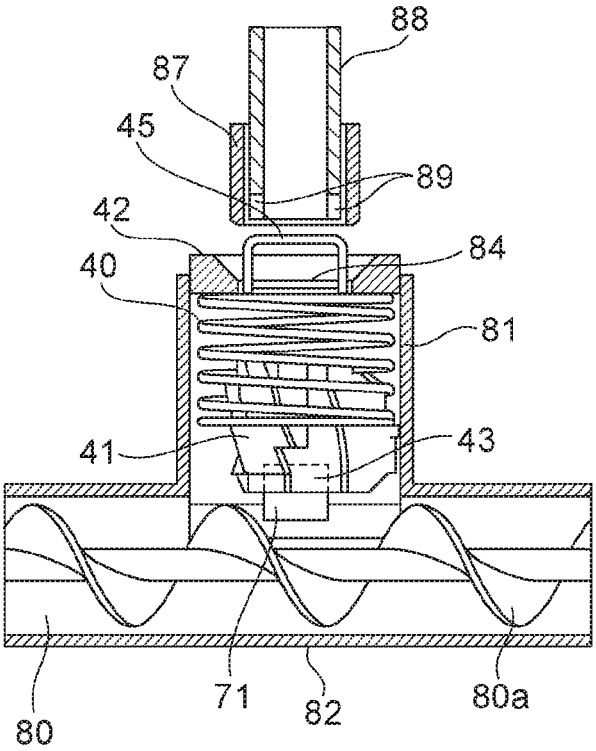
FIG. 18 is a cross-sectional view of the transmission spring and the driving member of the cartridge separated from each other.

FIG. 11 is a cross-sectional view of the transmission spring 41 compressed by an end of the driving member of the cartridge. FIG. 18 is a cross-sectional view of the transmission spring 41 and the driving member of the cartridge separated from each other.

As illustrated in FIG. 6, a spring clamp 42 is disposed around the toner receiving unit 84 in the toner conveying path 81. In other words, the spring clamp 42 is provided with the toner receiving unit 84. The toner receiving unit 84 is a hole through which toner can pass and serves also as a discharge port through which toner is discharged toward the conveying fin 41. An end of the toner receiving unit 84 is positioned outside the discharge port 88*a* viewed from the axial direction of the driving member 88 described above so as not to hinder the motion of the toner discharged from the discharge port 88*a* of the driving member 88. In other words, the toner receiving unit 84 is positioned outside the discharge port 88*a* in the radial direction of the discharge port 88*a*.

As illustrated in FIG. 18, in a state in which the transmission spring 40 does not engage with the driving member 88, the transmission spring 40 is supported by butting against the spring holder 42 at an end face. The transmission spring 40 has an urging force of about 33 gf in a state of butting against the spring holder 42 (not connected to the cartridge 25), and an urging force of about 50 gf in a state of being connected to the driving member 88 of the cartridge 25.

As described above, the connecting member 87 operates in conjunction with the opening and closing operation of the front door of the apparatus main body 11. The driving member 88 operates in conjunction with the motion of the connecting member 87. When the front door is closed, the connecting member 87 is pushed up by a link mechanism (not illustrated). The driving member 88 moves to an engaging position at which the first engaging portion 45 and the engaging grooves 89 engage with each other. When the front door is opened, the connecting member 87 is pushed up by the link mechanism (not illustrated). The driving member 88 moves to a separating position at which the first engaging portion 45 and the engaging grooves 89 are separated from each other. In other words, the driving member can move between the engaging position and the separating position.

When the front door is closed, the driving member 88 of the connecting member 87 of the cartridge 25 pushes (compresses) the transmission spring 40 downward against the reactive force of the transmission spring 40.

Furthermore, the transmission spring 40 butts against the driving member 88 in the connecting member 87. The butting driving member 88 rotates in conjunction with the rotation of the photosensitive drum 20. This causes the grooves 89 of the driving member 88 to engage with the first engaging portion 45 of the transmission spring 40.

When the connecting member 87 joins with the toner conveying path 80 on the apparatus main body side, the position of the first engaging portion 45 of the transmission spring 40 can be out of the grooves 89 of the driving member 88 on the cartridge side. In this case, the grooves 89 and the first engaging portion 45 cannot engage with each other, and the transmission spring 40 can be pushed down by the end 90 of the driving member 88 (see FIG. 11). At that time, only the driving member 88 rotates, with the transmission spring 40 pushed down by the end 90 of the driving member 88. When the driving member 88 rotates so that the first engaging portion 45 of the transmission spring 40 and the grooves 89 of the driving member 88 engage with each other, the transmission spring 40 and the driving member 88 engage with each other into the state in FIG. 6, described above, in which the transmission spring 40 rotates together with the conveying fin 41.

Thus, the transmission spring 40 on the apparatus main body side and the driving member 88 on the cartridge side can engage in any phase relationship.

Example Transmission Member

The structure of the transmission spring 40, which is a transmission member (an elastic member) in the present embodiment, will be described in detail hereinbelow.

In the following description, a linear material forming the transmission spring 40 is simply referred to as "wire". However, this is not intended to limit the material to metal. A non-metallic material, such as resin, that has the function of the elastic member (spring) may be used for part or all of the transmission spring 40.

The transmission spring 40 in the present embodiment is a compression coil spring that is compressed in the axial direction of the spring by the driving member 88 in the engaging position. The diameter of the wire is 0.6 mm. The material is a general metallic material for springs, for example, a stainless steel or a piano wire.

Figure 1:
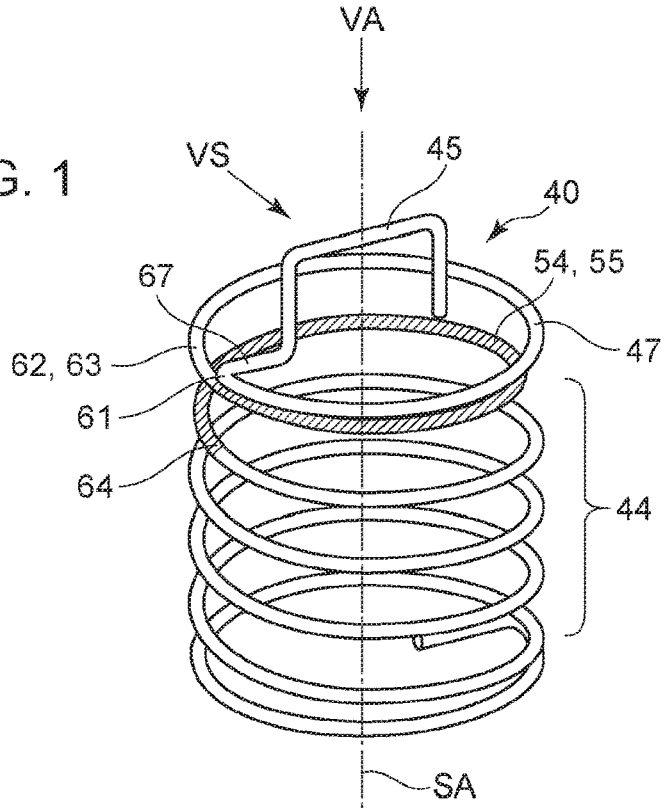
FIG. 1 is a perspective view of a transmission spring according to a first example embodiment of the present disclosure.
Figure 2:
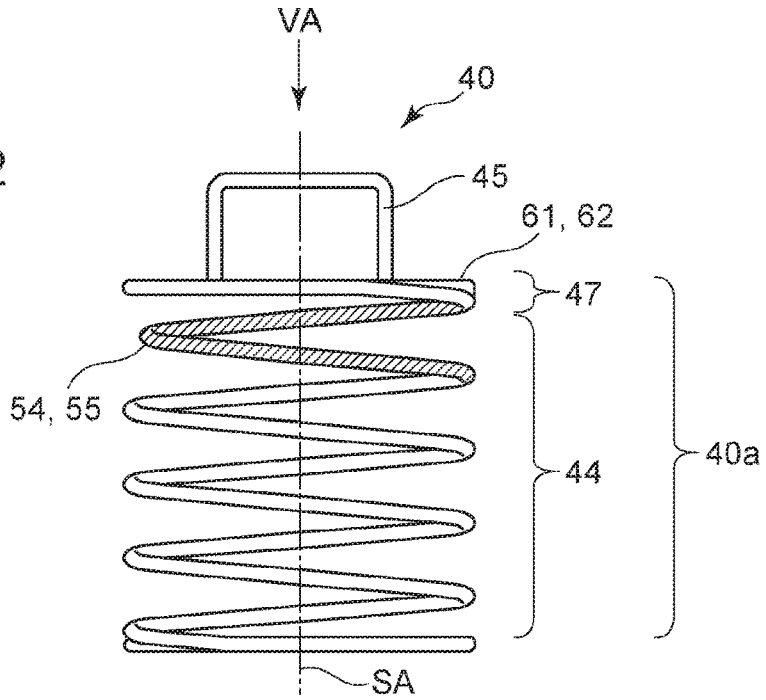
FIG. 2 is a side view of the transmission spring according to the first embodiment.
Figure 3:
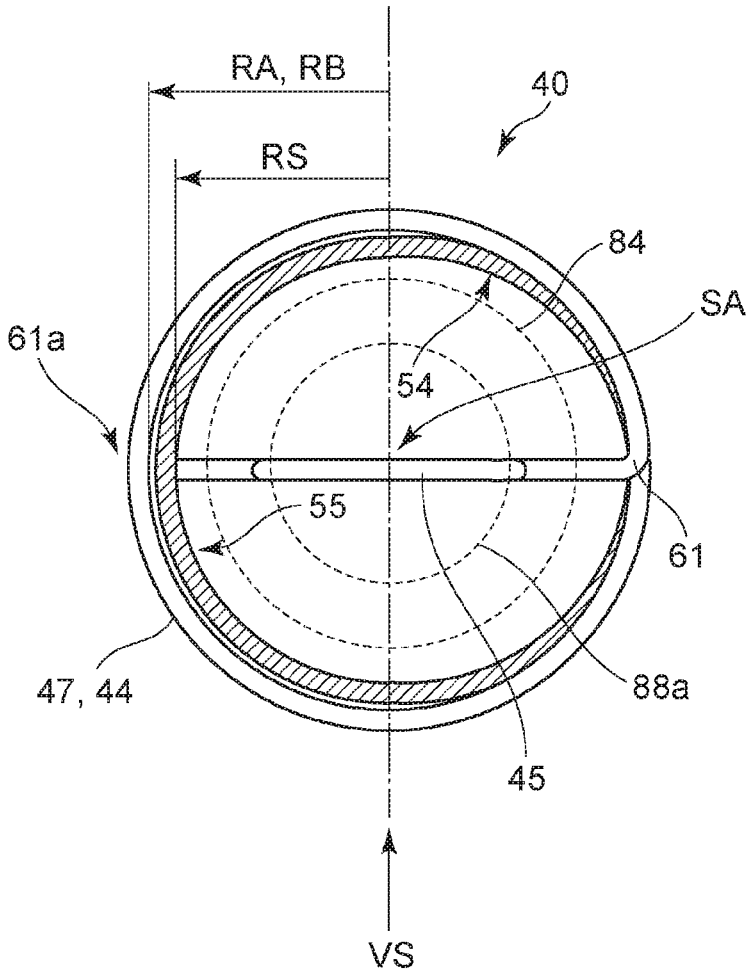
FIG. 3 is a diagram illustrating the transmission spring in the first embodiment projected to a plane perpendicular to the axis of the transmission spring.

The details of the transmission spring 40 will be described with reference to FIGS. 1 to 3. FIG. 1 is a perspective view of the transmission spring 40 in the first embodiment. FIG. 2 is a side view of the transmission spring 40 in the first embodiment. FIG. 3 is a diagram illustrating the transmission spring 40 in the first embodiment projected to a plane perpendicular to the axis of the transmission spring 40.

Reference sign VA in FIG. 1 denotes a direction parallel to the axis of the spring portion 40*a* (to be described later). Reference sign VS denotes a direction perpendicular to the direction VA and perpendicular to the first engaging portion 45 (to be described later).

FIG. 2 is a side view of the transmission spring 40 viewed from the direction VS in FIG. 1.

FIG. 3 is a projection view of the transmission spring 40 viewed from the direction VA in FIG. 1. Reference sign VS in FIG. 3 is VS in FIGS. 1 and 2. In other words, FIG. 3 is a diagram of the transmission spring 40 projected in the direction of the axis (SA) of the transmission spring 40 to a plane perpendicular to the axis (SA). Accordingly, FIG. 3 is substantially the same as a diagram of the transmission spring 40 viewed from a direction perpendicular to the plane in a state in which an end opposite to an end at which the first engaging portion 45 is disposed is in contact with the plane.

As illustrated in FIGS. 1 and 2, the transmission spring 40 includes the first engaging portion 45, which engages with the driving member 88, at an end (a distal end) of the transmission spring 40. The first engaging portion 45 projects from the end of the transmission spring 40 in the direction of the axis of the spring portion 40*a*.

The transmission spring 40 includes the spring portion 40*a* having a spiral shape. The spring portion 40*a* includes an end turn 47 and an active wound portion 44 (to be described later). The spiral shape in the following description is a shape in which the wire of the spring portion 40*a* is wound around the axis at an angle with respect to a plane perpendicular to the axis of the spring portion 40*a*. The distance between the wire and the axis does not need to gradually decrease toward the inside of the wire.

The transmission spring 40 includes a connecting portion 67 connecting the first engaging portion 45 and the spring portion 40*a* together. The connecting portion 67 extends in a direction crossing the axis of the spring portion 40*a*. The connecting portion 67 is connected to the end turn 47.

The spring portion 40*a* includes the end turn 47 wound from a starting point 61 to an end point 62. The end turn 47 is wound about one turn. The wire at the starting point 61 and the wire at the end point 62 are adjacent (in the present embodiment, close) to each other. The end turn 47 has a spiral shape wound around the axis. The end turn 47 is connected to the connecting portion 67 at the starting point 61. The end turn 47 is a first wound portion in the present embodiment.

The end point 62 of the end turn is connected to the active wound portion 44. The active wound portion 44 is wound from the end point 62 of the end turn 47, which is a starting point 63, to an end opposite to the end at which the first engaging portion 45 is provided. The active wound portion 44 also has a spiral shape wound around the axis. The active wound portion 44 is a second wound portion in the present embodiment. The active wound portion 44 includes a different-radius portion 54 and a small-radius portion 55, described later.

The end turn 47 has a smaller pitch angle than the pitch angle of the active wound portion 44 and has a function for stabilizing the posture of the first engaging portion 45 when supported by the spring clamp 42 described above. The end turn 47 has a small spring function. The active wound portion 44 is a portion of the spring portion 40*a* excluding the end turn 47. The active wound portion 44 is a portion of the spring portion 40*a* in which adjacent wires are separated from each other and which substantially has the function of spring. In other words, the pitch angle (an angle at which the center line of the wire is inclined with respect to a plane perpendicular to the axis of the spring portion 40*a*) of the end turn 47 differs from the pitch angle of the active wound portion 44. The pitch angle of the end turn 47 is smaller than the pitch angle of the active wound portion 44.

The active wound portion 44 has the different-radius portion 54 wound from the starting point 63 to a point 64 so as to differ in radius from the end turn 47. The different-radius portion 54 is a hatched portion in FIGS. 1 to 3. The different-radius portion 54 further includes the small-radius portion 55. The small-radius portion 55 in the present embodiment is a portion of which the radius of the outer portion in the direction perpendicular to the axis of the spring portion 40*a* is smaller than the radius of a central portion between the outer portion and the inner portion of the end turn 47 (the first wound portion). In other words, in the present embodiment, the small-radius portion 55 starts from an intermediate point of the different-radius portion 54. As will be described later, the small-radius portion 55 of the present embodiment has a fixed radius (a radius of 6 mm of the inner portion) from an intermediate point.

The above portions will be described using specific dimensions as examples. In the following description, the diameter of the wire is for a cross section perpendicular to the center line of the wire. The radius of the spring portion 40*a* is a distance from the axis to a portion whose radius is to be measured in the direction perpendicular to the axis of the spring portion 40*a* (in the radial direction).

In FIG. 3, the radius RA of the inner portion of the end turn 47 is 7 mm in the radial direction of the spring portion 40*a*. In other words, the inside diameter of the end turn is 14 mm. Since the diameter of the wire is 0.6 mm, the radius of the outer portion of the end turn 47 is 7.6 mm. In other words, the outside diameter of the end turn 47 is 15.2 mm. The radius of the mid-portion between the outer portion and the inner portion of the end turn 47 is 7.3 mm. In other words, the mean diameter of the end turn 47 is 14.6 mm.

The mid-portion between the inner portion and the outer portion of the wound portion (the active wound portion, the end turn, and so on) of the spring portion 40*a* is hereinafter referred to as a wire mid-portion. The wire mid-portion is aligned with a portion of the wire through which the center line passes. In other words, the diameter of the wire mid-portion of the wound portion is equal to the mean diameter of the spring portion 40*a* in the direction perpendicular to the axis of the spring portion 40*a*.

The radius RB of a portion of the active wound portion 44 excluding the different-radius portion 54 and the small-radius portion 55 is equal to the radius RA.

In FIG. 3, the radius of the different-radius portion 54 at the starting point 63 is equal to the radius of the end turn 47. The different-radius portion 54 is wound toward the point 64. The radius of the different-radius portion 54 decreases from the starting point 63 toward the point 64. The radius of the different-radius portion 54 increases toward the point 64 through the small-radius portion 55. The radius becomes equal to the radius of the end turn 47 at the point 64. In other words, the radius RA of the end turn 47 is larger than the radius of the different-radius portion 54. The different-radius portion 54 includes the small-radius portion 55 which is projected to a position where it does not overlap with the end turn 47 when projected in the direction of the axis of the spring portion 40*a* to a plane perpendicular to the axis.

The small-radius portion 55 will be further described. The different-radius portion 54 includes the small-radius portion 55. The minimum radius RS of the inner portion of the small-radius portion 55 is 6 mm in the radial direction of the spring portion 40*a*. The minimum radius of the outer portion of the small-radius portion 55 is 6.6 mm. Accordingly, the minimum radius of the wire mid-portion of the small-radius portion 55 is 6.3 mm. In other words, the outer portion of the small-radius portion 55 in the present embodiment includes a portion (radius: 7 mm) inside the inner portion (radius: 6.6 mm) of the end turn 47.

In summary, the spring portion 40*a* in the present embodiment includes the end turn 47 (the first wound portion) and the active wound portion 44 (the second wound portion). The active wound portion 44 includes the different-radius portion 54 described above. The different-radius portion 54 of the active wound portion 44 includes the small-radius portion 55 described above. The spring portion 40*a* in the present embodiment includes a portion (the end turn 47 and the active wound portion 47 excluding the different-radius portion 54) having a diameter larger than that of the small-radius portion 55 at one end and the other end of the small-radius portion 55 in the direction of the axis of the spring portion 40*a*.

In other words, the shape of the spring portion 40*a* is as follows. When the spring portion 40*a* is projected in the direction of the axis of the spring portion 40*a* to a plane perpendicular to the axis of the spring portion 40*a*, the outer portion of the small-radius portion 55 is projected to the inside of the wire mid-portion of the end turn 47 in the direction perpendicular to the axis. The "inside" means a portion adjacent to the axis of the spring portion 40*a*. In other words, the distance between the portion and the axis of the spring portion 40*a* is small. Since, in the present embodiment, the radius of the wire mid-portion of the end turn is 7.3 mm, the radius of the outer portion of the small-radius portion 55 is less than 7.3 mm.

In the present embodiment, the radius of the small-radius portion 55 is smaller than the radius of the wire mid-portion of the end turn 47. In other words, when the spring portion 40*a* is projected in the direction of the axis of the spring portion 40*a* to a plane perpendicular to the axis of the spring portion 40*a*, the outer portion of the small-radius portion 55 is projected to the inside of the inner portion of the end turn 47 in the direction perpendicular to the axis. Since in this case the radius of the inner portion of the end turn 47 is 7 mm, the outer portion of the small-radius portion 55 is less than 7 mm.

The shape of the small-radius portion 55 can also be expressed as follows. In FIG. 3, the small-radius portion 55 is positioned between the wire mid-portion of the end turn 47 and the intersection (radius: 7.3 mm) of a straight line extending from the axis of the spring portion 40*a* in the radial direction of the spring portion 40*a*.

Furthermore, the small-radius portion 55 of the present embodiment is positioned between the axis of the spring portion 40*a* and the intersection (radius: 7 mm) of the straight line extending from the axis of the spring portion 40*a* in the radial direction of the spring portion 40*a* and the inner portion of the end turn 47.

In the present embodiment, the center axis of a portion of the active wound portion 47 excluding the different-radius portion 54 is the axis SA of the spring portion 40*a*.

If the active wound portion 44 and the end turn 47 has the same radius, the active wound portion 44 and the end turn 47 overlap in a projection view in the direction of the axis, so that when the end turn 47 is pressed down, the end turn 47 can come into a position under the wire of the active wound portion 44. At that time, the posture of the first engaging portion 45 tilts, which is undesirable.

The transmission spring 40 can be moved relatively freely before or when assembled. For that reason, the end turn 47 can enter under the wire of the active wound portion 44. Therefore, when it is detected that the end turn 47 has entered under the wire and has not returned even by the returning force of the spring portion 40*a*, the need for returning the end turn 47 can arise.

The shape of the present embodiment allows the end turn 47 to be returned from the position under the wire if the end turn 47 has entered. The occurrence of the entering itself can be prevented. Since the outer portion of the small-radius portion 55 is disposed inside the inner portion of the end turn 47, the occurrence of the entering can be prevented more reliably. Accordingly, the engagement of the spring on the apparatus main body side and the rotational member on the cartridge side can be stabilized even without the need for checking at the assembly.

As described above, part of the different-radius portion 54 and the end turn 47 do not overlap with each other. Therefore, even if the first engaging portion 45 is pressed down, the end turn 47 is prevented from entering under the different-radius portion 54 because the radius of the pressed end turn 47 is larger than the radius of the different-radius portion 54. Furthermore, even if the end turn 47 enters under the wire, the amount of overlapping is small. This allows the cartridge and the toner conveying unit of the apparatus main body to be engaged with stability without the need for checking at the assembly of the transmission spring 40.

In the present embodiment, the end turn 47 connected to the first engaging portion 45 is provided, and the different-radius portion 54 and the small-radius portion 55 are disposed at the portion adjacent thereto. Since the end turn 47 has a small pitch angle, the returning force from the entering, if occurred, is small. Accordingly, providing the end turn 47 connected to the first engaging portion 45 and the small-radius portion 55 adjacent thereto as in the present embodiment provides greater advantages in resolving the entering and preventing the occurrence of entering.

As illustrated in FIG. 3, a portion 61*a* opposite to the point 61 at which the connecting portion 67 and the end turn 47 are connected, with the axis therebetween, is disposed so as to overlap with the small-radius portion 55 in the circumferential direction around the axis. In the present embodiment, the small-radius portion 55 is a portion of about 180 degrees from the point 61 at which the connecting portion 67 and the end turn 47 are connected, with the axis therebetween. This further increases the effect of resolving the entering and preventing the occurrence of entering. The range in which the small-radius portion is provided in the circumferential direction (the winding direction) of the spring portion 40*a* may be smaller than or larger than 180 degree described above.

In the present embodiment, the end turn 47 is a portion in contact with the spring clamp 42. To stabilize the posture of the transmission spring 40, the end turn 47 is preferably in contact with the spring clamp 42 at a position where the end turn 47 does not overlap with the toner receiving port 84. For that purpose, the active wound portion 44 adjacent to the end turn 47 is provided with the small-radius portion 55 without changing the size of the end turn 47. This allows the end turn 47 to come into contact with the outside of the toner receiving port 84 even if the toner receiving port 84 is large. If the toner receiving port 84 is large, the conveying path can be made wide as a whole by making a toner discharge port 88*a* wide.

The smaller the diameter of the small-radius portion 55, the easier the entering can be prevented. However, for use in a toner conveying path, the excessively small-radius of the small-radius portion 55 can hinder the flow of the toner. In particular, in the present embodiment, the inner portion of the small-radius portion 55 is disposed outside the discharge port 88*a* in the direction perpendicular to the axis of the spring portion 40*a*. Furthermore, the toner receiving port 84 is disposed outside the discharge port 88*a*. The inner portion of the small-radius portion 55 is disposed outside the toner receiving port 84. In other words, the flow of the toner discharged toward the conveying fin 41 is not obstructed by the small-radius portion 55.

Thus, the configuration illustrated in the present embodiment prevents occurrence of a state in which deformation of the transmission member that transmits driving from the driving member to the driven member is kept.

Second Example Embodiment

A second embodiment of the transmission spring 40 will be described with reference to FIGS. 12 to 14. Since the peripheral components other the transmission spring 40 are the same as those of the first embodiment, detailed descriptions will be omitted. The characteristic shape of a transmission spring 140 in the second embodiment will be mainly described. The wire diameter of the transmission spring 140 in the second embodiment is 0.6 mm.

Figure 12:
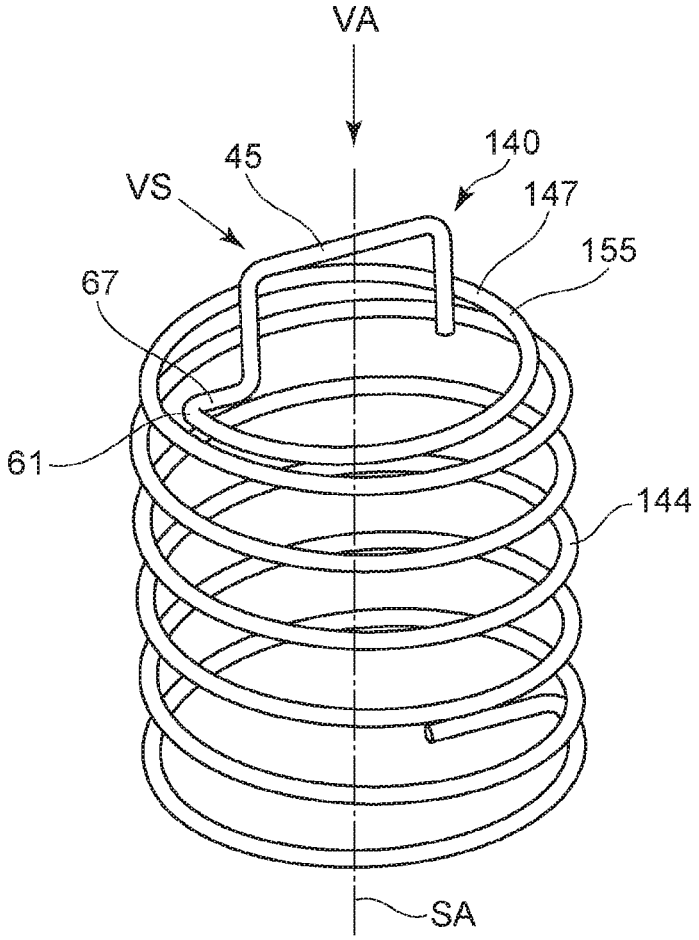
FIG. 12 is a perspective view of a transmission spring according to a second example embodiment of the present disclosure.
Figure 13:
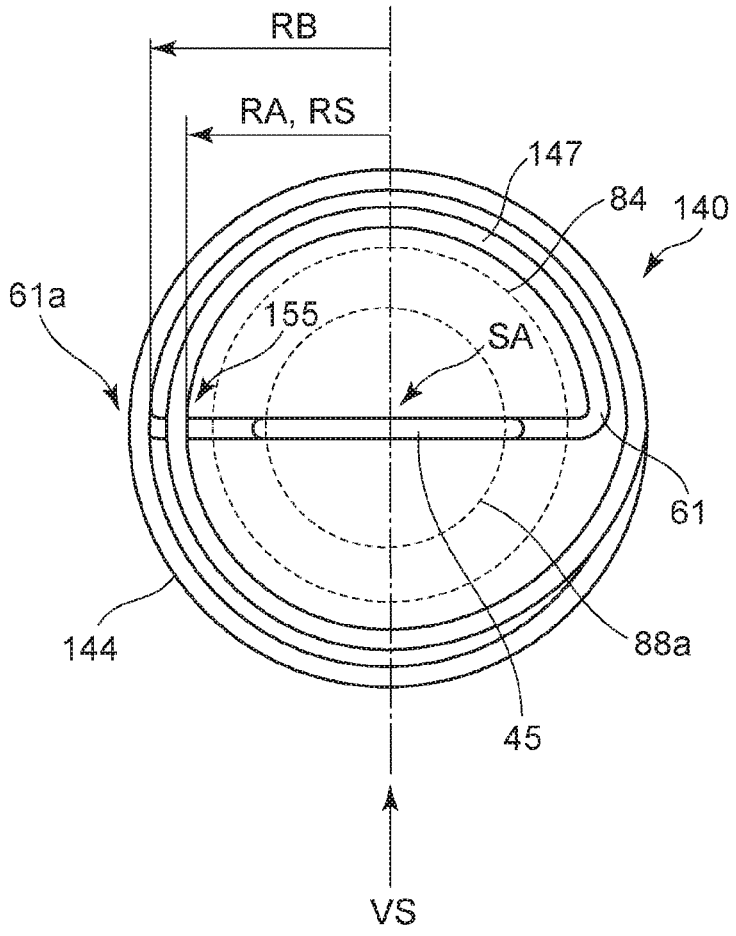
FIG. 13 is a diagram of the transmission spring in the second embodiment projected in the direction of the axis.

FIG. 12 is a perspective view of the transmission spring 140 in the second embodiment. FIG. 13 is a diagram of the transmission spring 140 in the second embodiment projected in the direction of the axis to a plane perpendicular to the axis. FIG. 14 is a side view of the transmission spring 140 in the second embodiment. In the drawings, the directions VA and VS are the same as the directions VA and VS in the first embodiment.

In the first embodiment, one of the adjacent wound portions of the spring portion 40*a* of the transmission spring 40 has the small-radius portion 55 having a smaller diameter than that of the wire mid-portion (or the inner portion) of the other wound portion. In particular, the small-radius portion 55 in the first embodiment is disposed at the active wound portion 44 connected to the end turn 45. In other words, the radius of the end turn 45 is larger than the radius of the small-radius portion 55.

In contrast, a small-radius portion 155 of the second embodiment is disposed at an end turn 147. In other words, the radius of an active wound portion 144 is larger than the radius of the small-radius portion 155.

In other words, in the present embodiment, the end turn 147 corresponds to the second wound portion including the small-radius portion 155, and the active wound portion 144 corresponds to the first wound portion.

The transmission spring 140 in the second embodiment includes a spring portion 140*a*. The spring portion 140*a* includes the end turn 147 and the active wound portion 144. The radius of the end turn 147 is smaller than the radius of the active wound portion 144. This prevents the end turn 147 from overlapping with the active wound portion 144 adjacent to the end turn 147.

Specifically, the radius RA of the inner portion of the end turn 147 is 6 mm in the direction perpendicular to the axis of the spring portion 140*a* (in the radial direction of the spring portion 140*a*). The radius of the outer portion of the end turn 147 is 6.6 mm. In other words, the radius of the wire mid-portion of the end turn 147 is 6.3 mm.

The radius RB of the inner portion of the active wound portion 144 is 7 mm, and the inside diameter of the active wound portion 144 is 14 mm. The radius of the outer portion of the active wound portion is 7.6 mm, and the outside diameter of the active wound portion is 15.2 mm. In other words, the radius of the wire mid-portion of the active wound portion 144 is 7.3 mm, and the mean diameter of the active wound portion is 14.6 mm. In other words, the radius RB of the active wound portion 144 is larger than the radius RA of the end turn 147.

The small-radius portion 155 will be further described. The end turn 147 includes the small-radius portion 155. The minimum radius RS of the inner portion of the small-radius portion 155 is 6 mm in the radial direction of the spring portion 140*a*. The minimum radius of the outer portion of the small-radius portion 155 is 6.6 mm. Accordingly, the minimum radius of the wire mid-portion between the outer portion and the inner portion of the small-radius portion 155 is 6.3 mm. In other words, the outer portion of the small-radius portion 155 in the present embodiment includes a portion (with a radius of 6.6 mm) inside the inner portion (radius: 7 mm) of the active wound portion 144.

This configuration prevents the end turn 147 from entering under the active wound portion 144 even if the first engaging portion 45 is pushed down.

Figure 14:
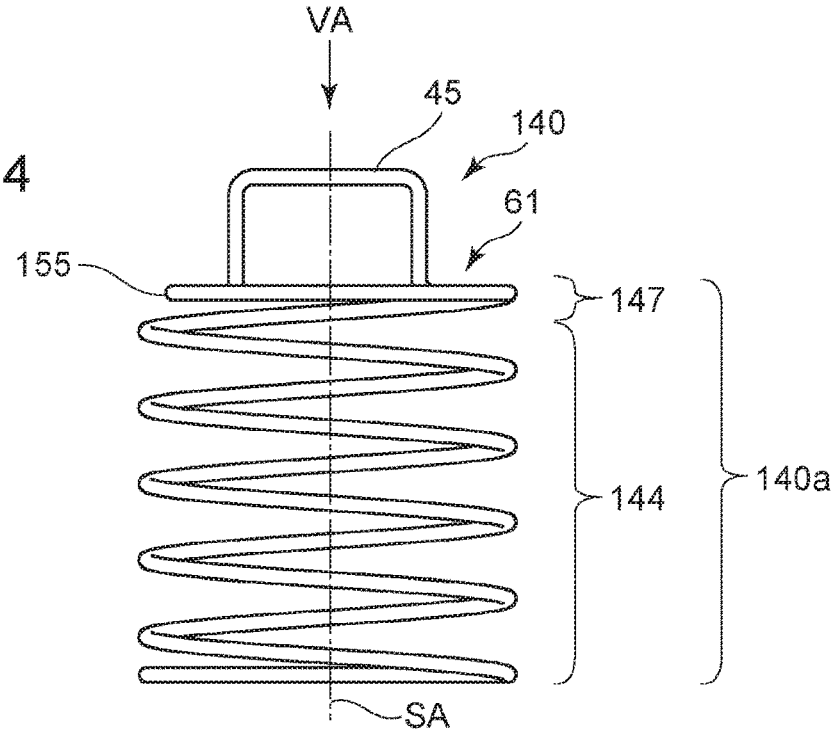
FIG. 14 is a side view of the transmission spring in the second embodiment.

FIG. 14 is a side view of the transmission spring 140. In other words, the transmission spring 140 includes the active wound portion 144 wound around the axis and the first engaging portion 45 provided at an end of the transmission spring 140. The transmission spring 140 further includes the end turn 147 wound differently from the active wound portion 144 at a position adjacent to the first engaging portion 45 with respect to the active wound portion 144. The radius of the transmission spring 140 may be appropriately adjusted to the size of the toner conveying path 80.

In summary, the spring portion 140*a* in the present embodiment includes the active wound portion 144 (the first wound portion) and the end turn 147 (the second wound portion). The end turn 147 includes the small-radius portion 155.

In other words, the shape of the spring portion 140*a* is as follows. When the spring portion 140*a* is projected in the direction of the axis of the spring portion 140*a* to a plane perpendicular to the axis, the outer portion of the small-radius portion 155 is projected inside the wire mid-portion of the active wound portion 144 in the direction perpendicular to the axis. Since the radius of the wire mid-portion of the active wound portion 147 is 7.3 mm, the radius of the outer portion of the small-radius portion 155 is less than 7.3 mm.

In the present embodiment, the radius of the small-radius portion 155 is smaller than the radius of the wire mid-portion of the active wound portion 144. In other words, when the spring portion 140*a* is projected in the direction of the axis of the spring portion 140*a* to a plane perpendicular to the axis of the spring portion 140*a*, the outer portion of the small-radius portion 155 is projected inside the inner portion of the active wound portion 144 in the direction perpendicular to the axis. In this case, since the radius of the inner portion of the active wound portion is 7 mm, the outer portion of the small-radius portion 155 is less than 7 mm.

Furthermore, also in the present embodiment, the inner portion of the small-radius portion 155 is disposed outside the discharge port 88*a* in the direction perpendicular to the axis of the spring portion 140*a*. Furthermore, the toner receiving port 84 is disposed outside the discharge port 88*a*. The inner portion of the small-radius portion 155 is disposed outside the toner receiving port 84*a*.

Furthermore, in the present embodiment, the end turn 147 (the second wound portion) and the connecting portion 67 are connected together. The relationship among the point 61 at which the end turn 147 and the connecting portion 67 are connected, the point 61*a* opposite thereto, and the small-radius portion 155 in the circumferential direction around the axis of the spring portion 140*a* is the same as in the first embodiment.

As described above, the configuration of the present embodiment reduces or eliminates occurrence of a state in which the deformation of the transmission member that transmits driving from the driving member to the driven member is kept.

Third Example Embodiment

Figure 16:
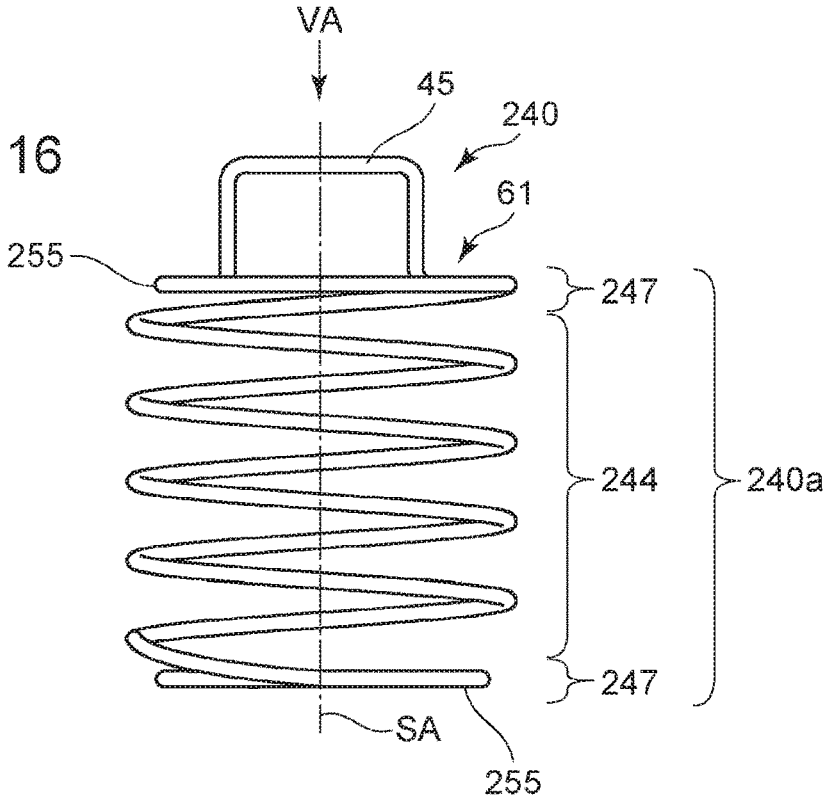
FIG. 16 is a side view of the transmission spring in the third embodiment.
Figure 17:
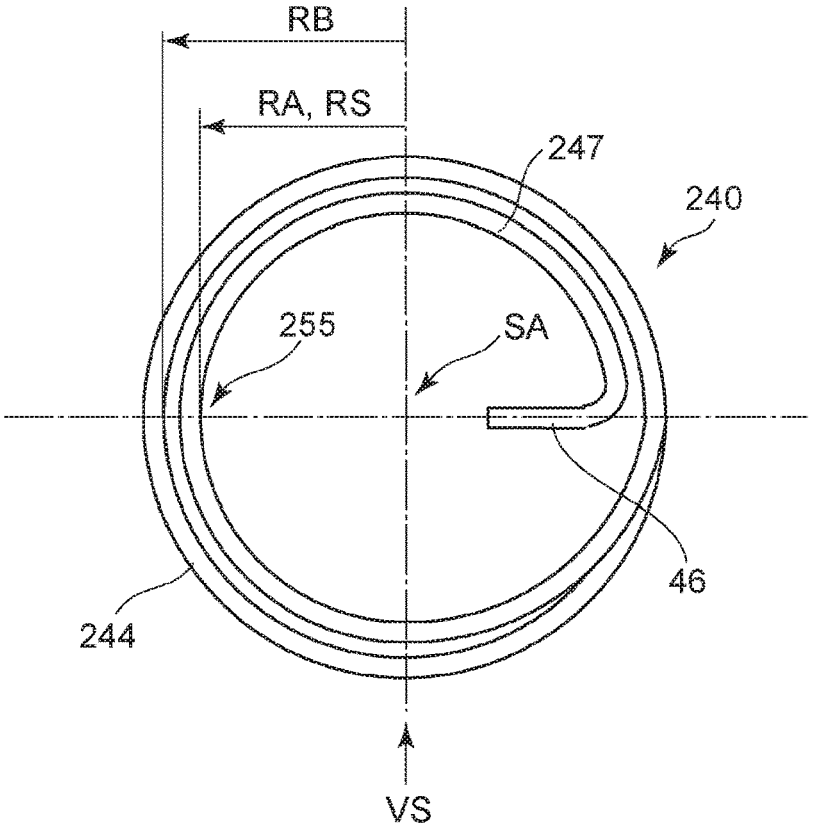
FIG. 17 is a diagram of the transmission spring in the third embodiment projected in the direction of the axis.

A third embodiment of the transmission spring 40 will be described with reference to Referring to FIGS. 15 to 17. Since the peripheral components other the transmission spring 40 are the same as those of the first embodiment, detailed descriptions will be omitted. The wire diameter of a transmission spring 240 in the third embodiment is 0.6 mm.

In the first embodiment, one of the adjacent wound portions of the spring portion 40*a* of the transmission spring 40 has the small-radius portion 55 having a smaller diameter than that of the wire mid-portion (or the inner portion) of the other wound portion. In particular, the small-radius portion 55 in the first embodiment is disposed at the active wound portion 44 connected to the end turn 45. In other words, the radius of the end turn 45 is larger than the radius of the small-radius portion 55.

In contrast, the small-radius portion 155 of the second embodiment is disposed at the end turn 147. In other words, the radius of the active wound portion 144 is larger than the radius of the small-radius portion 155. In other words, in the second embodiment, the end turn 147 corresponds to the second wound portion including the small-radius portion 155, and the active wound portion 144 corresponds to the first wound portion.

In the third embodiment, a small-radius portion 255 is provided also at a second engaging portion 46 disposed opposite to the first engaging portion 45. This will be described below.

Figure 15:
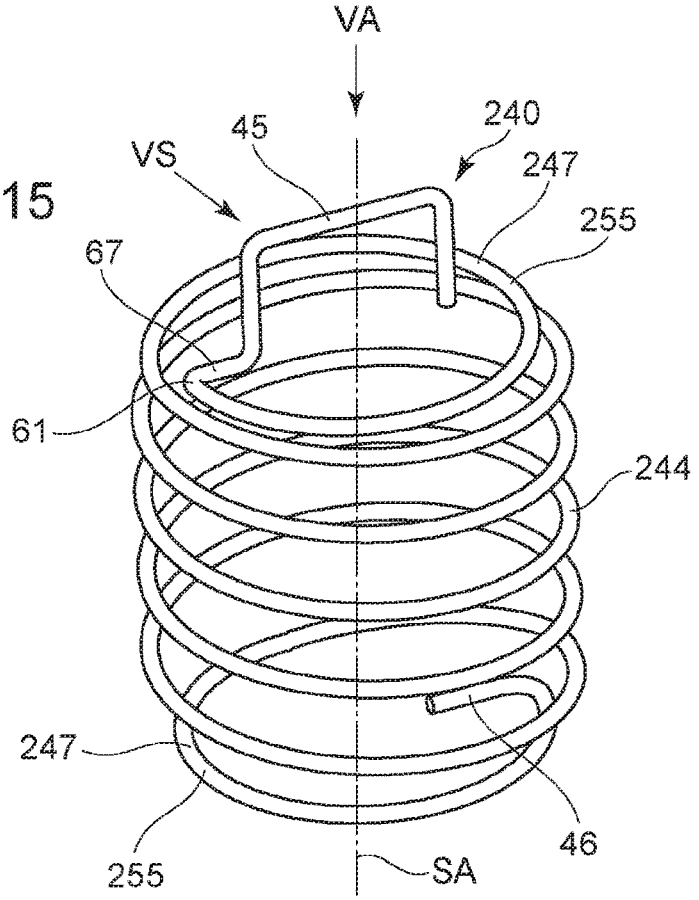
FIG. 15 is a perspective view of a transmission spring according to a third example embodiment of the present disclosure.

FIG. 15 is a perspective view of the transmission spring 240 in the third embodiment. FIG. 16 is a side view of the transmission spring 240 in the third embodiment. FIG. 17 is a diagram of the transmission spring 240 in the third embodiment projected in the direction of the axis to a plane perpendicular to the axis. In the drawings, the directions VA and VS are the same as the directions VA and VS in the first embodiment.

The transmission spring 240 includes an active wound portion 244 wound around the axis thereof, and the first engaging portion 45 and the second engaging portion 46 provided at the ends of the transmission spring 240. The transmission spring 240 includes end turns 247, at both ends of the active wound portion 244, wound so as to have different radius from the radius of the active wound portion 244. For ease of description, the first engaging portion 45 and the end turn 247 adjacent to the first engaging portion 45 of the transmission spring 240 are hidden in FIG. 17.

As illustrated, part of the end turn 247 is disposed so as not to overlap with part of the active wound portion 244 adjacent to the end turn 247. The radius RA of part of the end turn 247 differs from the radius RB of part of the active wound portion 244 adjacent to the end turn 247.

Since the relationship between the size of the small-radius portions 255 and the size of the other portions in the direction perpendicular to the axis of a spring portion 240*a* (the radial direction of the spring portion 240*a*) is the same as in the second embodiment, a description thereof will be omitted.

Although the configuration in which the end turns 247 each include the small-radius portion 255 has been described, the small-radius portions 255 may be provided at the active wound portion 244 adjacent to the end turns 247 at both ends, as in the first embodiment.

This prevents the end turn 247 adjacent to the conveying fin 41 from entering under the active wound portion 244, so that an unnecessary checking process can be omitted, and the cartridge 25 and the toner conveying unit of the apparatus main body 11 can be engaged with stability.

Thus, the configuration of the present embodiment prevents occurrence of a state in which deformation of the transmission member that transmits driving from the driving member to the driven member is kept.

In the first to third embodiments described above, a full-color image forming apparatus to which four process cartridges are removably mounted is illustrated. However, the number of process cartridges to be mounted to the image forming apparatus is not limited to four.

The configurations of the present embodiments prevent occurrence of a state in which deformation of the transmission member that transmits driving from the driving member to the driven member is kept.

While the present invention has been described with reference to example embodiments, it is to be understood that the invention is not limited to the disclosed example embodiments. The scope of the following claims is to be accorded the broadest interpretation so as to encompass all such modifications and equivalent structures and functions.

This application claims the benefit of Japanese Patent Application No. 2017-199629, filed Oct. 13, 2017, which is hereby incorporated by reference herein in its entirety.

What is claimed is:

1. A conveying unit driven by a driving member to convey a developer, the conveying unit comprising:

a conveying member configured to covey the developer; and a transmission member configured to transmit driving of the driving member to the conveying member, the transmission member including:

a first engaging portion for engaging with the driving member, the first engaging portion being disposed at an end of the transmission member;

a second engaging portion for engaging with the conveying member; and a spring portion having a shape wound around an axis, the spring portion being to be compressed in a direction of the axis, the spring portion including:

a first wound portion wound around the axis; and a second wound portion wound around the axis, the second wound portion being connected to the first wound portion and including a small-radius portion, wherein the small-radius portion is disposed such that, when the spring portion is projected in the direction of the axis, an outer portion of the small-radius portion is projected to inside of a mid-portion between an outer portion of the first wound portion and an inner portion of the first wound portion in a direction perpendicular to the axis.

2. The conveying unit according to claim 1, wherein the small-radius portion is disposed such that, when the spring portion is projected in the direction of the axis, the outer portion of the small-radius portion is projected to inside of the inner portion of the first wound portion in the direction perpendicular to the axis.

3. The conveying unit according to claim 1, wherein the driving member comprises a discharge port through which the developer is discharged toward the conveying member, and wherein an inner portion of the small-radius portion is disposed outside the discharge port in the direction perpendicular to the axis.

4. The conveying unit according to claim 1, wherein the spring portion comprises a compression coil spring, and wherein a pitch angle of the first wound portion differs from a pitch angle of the second wound portion.

5. The conveying unit according to claim 4, wherein the transmission member further comprises a connecting portion connecting the first wound portion and the first engaging portion together, the connecting portion extending in the direction perpendicular to the axis, and wherein the pitch angle of the first wound portion is smaller than the pitch angle of the second wound portion.

6. The conveying unit according to claim 5, wherein the small-radius portion overlaps, in a circumferential direction around the axis, with a portion opposite to a point at which the connecting portion and the first wound portion are connected.

7. The conveying unit according to claim 4, wherein the transmission member further comprises a connecting portion connecting the second wound portion and the first engaging portion together, the connecting portion extending in the direction perpendicular to the axis, and wherein the pitch angle of the second wound portion is smaller than the pitch angle of the first wound portion.

8. The conveying unit according to claim 7, wherein the small-radius portion overlaps, in a circumferential direction around the axis, with a portion opposite to a point at which the connecting portion and the second wound portion are connected.

9. The conveying unit according to claim 1, wherein the driving member is capable of changing between an engaging position at which the first engaging portion and the driving member engage with each other and a separating position at which the driving member is separated from the first engaging portion, and wherein the spring portion is compressed by the driving member in the engaging position.

10. An image forming apparatus comprising:

an apparatus main body including the conveying unit according to claim 1; and a replacement part removably mounted to the apparatus main body, the replacement part including an image bearing member configured to carry an electrostatic latent image, a cleaning member configured to remove the developer from a surface of the image bearing member, and the driving member configured to come into contact with the developer removed by the cleaning member.

11. A transmission member configured to transmit driving of a driving member to a driven member, the transmission member including:

a first engaging portion for engaging with the driving member, the first engaging portion being disposed at an end of the transmission member;

a second engaging portion for engaging with the driven member, and a spring portion having a shape wound around an axis, the spring portion being to be compressed in a direction of the axis, the spring portion including:

a first wound portion wound around the axis; and a second wound portion wound around the axis, the second wound portion being connected to the first wound portion and including a small-radius portion, wherein the small-radius portion is disposed such that, when the spring portion is projected in the direction of the axis, an outer portion of the small-radius portion is projected to inside of a mid-portion between an outer portion of the first wound portion and an inner portion of the first wound portion in a direction perpendicular to the axis.

12. The transmission member according to claim 11, wherein the small-radius portion is disposed such that, when the spring portion is projected in the direction of the axis, the outer portion of the small-radius portion is projected to inside of the inner portion of the first wound portion in the direction perpendicular to the axis.

13. The transmission member according to claim 11, wherein the driving member comprises a discharge port through which the developer is discharged toward the driven member, and wherein an inner portion of the small-radius portion is disposed outside the discharge port in the direction perpendicular to the axis.

14. The transmission member according to claim 11, wherein the spring portion comprises a compression coil spring, and wherein a pitch angle of the first wound portion differs from a pitch angle of the second wound portion.

15. The transmission member according to claim 14, further comprising a connecting portion connecting the first wound portion and the first engaging portion together, the connecting portion extending in the direction perpendicular to the axis, and wherein the pitch angle of the first wound portion is smaller than the pitch angle of the second wound portion.

16. The transmission member according to claim 15, wherein the small-radius portion overlaps, in a circumferential direction around the axis, with a portion opposite to a point at which the connecting portion and the first wound portion are connected.

17. The transmission member according to claim 14, further comprising a connecting portion connecting the second wound portion and the first engaging portion together, the connecting portion extending in the direction perpendicular to the axis, and wherein the pitch angle of the second wound portion is smaller than the pitch angle of the first wound portion.

18. The transmission member according to claim 17, wherein the small-radius portion overlaps, in a circumferential direction around the axis, with a portion opposite to a point at which the connecting portion and the second wound portion are connected.

19. The transmission member according to claim 11, wherein the driving member is capable of changing between an engaging position at which the first engaging portion and the driving member engage with each other and a separating position at which the driving member is separated from the first engaging portion, and wherein the spring portion is compressed by the driving member in the engaging position.

20. An image forming apparatus comprising:

an apparatus main body including the transmission member according to claim 11; and a replacement part removably mounted to the apparatus main body, the replacement part including an image bearing member configured to carry an electrostatic latent image, a cleaning member configured to remove a developer from a surface of the image bearing member, and the driving member configured to come into contact with the developer removed by the cleaning member.

* * * * *